US010758011B2

(12) United States Patent
Bock et al.

(10) Patent No.: US 10,758,011 B2
(45) Date of Patent: Sep. 1, 2020

(54) METHOD FOR LACING A SHOE, PARTICULARLY A SPORTS SHOE

(71) Applicant: PUMA SE, Herzogenaurach (DE)

(72) Inventors: Markus Bock, Herzogenaurach (DE); Randolph Maussner, Splat (DE)

(73) Assignee: PUMA SE, Herzogenaurach (DE)

( * ) Notice: Subject to any disclaimer, the term of this patent is extended or adjusted under 35 U.S.C. 154(b) by 84 days.

(21) Appl. No.: 15/780,368

(22) PCT Filed: Dec. 2, 2015

(86) PCT No.: PCT/EP2015/002425
§ 371 (c)(1),
(2) Date: May 31, 2018

(87) PCT Pub. No.: WO2017/092775
PCT Pub. Date: Jun. 8, 2017

(65) Prior Publication Data

US 2018/0368526 A1 Dec. 27, 2018

(51) Int. Cl.
*A43C 11/16* (2006.01)
*A43B 11/00* (2006.01)
(Continued)

(52) U.S. Cl.
CPC ..... *A43C 11/165* (2013.01); *A43B 3/0005* (2013.01); *A43B 11/00* (2013.01);
(Continued)

(58) Field of Classification Search
CPC ..... A43C 11/165; A43C 11/00; A43C 11/008; A43B 3/0005; A43B 11/00; B65H 59/384
(Continued)

(56) References Cited

U.S. PATENT DOCUMENTS 8,528,235 B2 * 9/2013 Beers ..... A43B 1/0027 36/137
8,769,844 B2 * 7/2014 Beers ..... A43B 3/0005 36/50.1
(Continued)

FOREIGN PATENT DOCUMENTS

DE 29817003 U1 3/1999
JP 3195320 B2 6/2001
(Continued)

OTHER PUBLICATIONS

Notice of Reasons for Refusal issued in Japanese Application No. 2018-524270, dated Dec. 3, 2019, 9 pages.
(Continued)

*Primary Examiner* — Alissa L Hoey
*Assistant Examiner* — Patrick J. Lynch
(74) *Attorney, Agent, or Firm* — Quarles & Brady LLP

(57) ABSTRACT

A method is disclosed for lacing a shoe that includes an upper on which a rotating closure is arranged for lacing the shoe by means of at least one tensioning element. The method includes lacing the shoe with a first level of lacing power, resulting in a first tension of the at least one tensioning element, when the user of the shoe generates a first closing signal (S1) by means of the closing button, or alternatively lacing the shoe with a second level of lacing power, resulting in a second tension of the at least one tensioning element, which is higher than the first tension, when the user of the shoe generates a second closing signal (S2) by means of the closing button, which is different from the first closing signal.

18 Claims, 2 Drawing Sheets

(51) Int. Cl.

| | |
|---|---|
| ***A43B 3/00*** | (2006.01) |
| ***A43C 11/00*** | (2006.01) |
| ***B65H 59/38*** | (2006.01) |

(52) U.S. Cl.
CPC ..... *A43C 11/00* (2013.01); *A43C 11/008* (2013.01); *B65H 59/384* (2013.01)

(58) Field of Classification Search
USPC ..... 36/50.1
See application file for complete search history.

(56) References Cited

U.S. PATENT DOCUMENTS

| | | | | |
|---|---|---|---|---|
| 9,693,605 | B2 | 7/2017 | Beers | |
| 10,476,410 | B2 * | 11/2019 | Schneider | A43C 11/165 |
| 2013/0104429 | A1 * | 5/2013 | Torres | A43B 3/0005 36/136 |
| 2014/0068838 | A1 * | 3/2014 | Beers | A61F 5/028 2/243.1 |
| 2014/0082963 | A1 | 3/2014 | Beers | |
| 2015/0289594 | A1 * | 10/2015 | Rushbrook | A43C 11/22 36/50.1 |
| 2016/0262485 | A1 * | 9/2016 | Walker | A43B 3/0005 |
| 2016/0345655 | A1 * | 12/2016 | Beers | A43B 3/001 |
| 2017/0265579 | A1 * | 9/2017 | Schneider | B65H 69/00 |

FOREIGN PATENT DOCUMENTS

| | | | |
|---|---|---|---|
| JP | 2004275201 | A | 10/2004 |
| JP | 2009011460 | A | 1/2009 |
| WO | 2014036374 | A1 | 3/2014 |
| WO | 2015014374 | A1 | 2/2015 |
| WO | 2015042216 | A1 | 3/2015 |
| WO | 2015045598 | A1 | 4/2015 |
| WO | 2015056633 | A1 | 4/2015 |

OTHER PUBLICATIONS

Search Report by Registered Search Organization issued in Japanese Application No. 2018-524270, dated Nov. 27, 2019, 128 pages.

* cited by examiner

METHOD FOR LACING A SHOE, PARTICULARLY A SPORTS SHOE

CROSS-REFERENCE TO RELATED APPLICATION

The present application is a 371 of International application PCT/EP2015/002425, filed Dec. 2, 2015, the priority of this application is hereby claimed and this application is incorporated herein by reference.

BACKGROUND OF THE INVENTION

The invention relates to a method for lacing a shoe, especially a sports shoe, wherein the shoe comprises:

an upper, wherein at or on the upper a rotating closure is arranged for lacing the shoe at the foot of the wearer by means of at least one tensioning element, wherein the rotating closure comprises a rotatably arranged tensioning roller, wherein the tensioning roller is driven by means of an electric motor, wherein the rotating closure has or comprises furthermore at least one closing button which closing button is connected to a control system which actuates the electric motor, wherein the lacing of the shoe is carried out by the user of the shoe generating a closing signal by means of the closing button.

A shoe with an electric motor operated rotating closure is known from DE 298 17 003 U1. Here, a tensioning roller is electric motor operated for winding of a tensioning element so that the shoe can be laced and de-laced automatically.

For lacing of the shoe an electric switch is operated by the user and the electric motor of the rotating closure is activated so long as the switch is pressed. Correspondingly, the tensioning force rises gradually. When a desired tensioning force level is reached the switch is released by the user. For de-lacing of the shoe another switch can be actuated respectively.

Accordingly the lacing of the shoe requires a respective time while the switch must be pressed by the user. Furthermore, the desired tensioning force level must be adjusted by the user at each lacing.

A method of the generic kind is disclosed in WO 2014/036374 A1. Similar and other solutions are shown in US 2014/0082963 A1 and US 2015/0289594 A1.

SUMMARY OF THE INVENTION

It is the object of the invention to further develop a method of the above mentioned kind in such a manner that the lacing of the shoe can be carried out more comfortable and in an easier manner. Thereby, it should be especially possible to adapt the lacing of the shoe to individual requirements conveniently. By doing so it should be possible to put on the shoe according to the desired requests of the user with a definite tensioning force level without a high handling effort.

The solution of this object by the invention is characterized in that the method comprises the steps:

lacing the shoe with a first level of lacing power, resulting in a first tension of the at least one tensioning element, when the user of the shoe generates a first closing signal by means of the closing button, wherein the first closing signal is a singular tap on the closing button to which no further tap impulse follows within a predetermined waiting time, or alternatively and additive respectively lacing the shoe with a second level of lacing power, resulting in a second tension of the at least one tensioning element, which is higher than the first tension, when the user of the shoe generates a second closing signal by means of the closing button, which is different from the first closing signal, wherein the second closing signal is a done twice tap on the closing button, wherein the two tap impulses follow within a predetermined following time and wherein no further tap impulse follows within a predetermined waiting time to the done twice tap.

In continuation of this concept it can further be provided that the method comprises alternatively and additive respectively the further step:

lacing the shoe with a third level of lacing power, resulting in a third tension of the at least one tensioning element, which is higher than the second tension, when the user of the shoe generates a third closing signal by means of the closing button, which is different from the first and second closing signal.

After obtaining of the first or second level of lacing power in dependence of the applied closing signal according to a further embodiment the step can be carried out:

increasing of the level of lacing power from the first level of lacing power to the second level of lacing power or from the second level of lacing power to the third level of lacing power when the user of the shoe generates a further closing signal by means of the closing button.

This further closing signal is preferably a singular tap on the closing button.

Accordingly, the proposed concept offers at first the possibility to reach different lacing force levels electric motor operated, wherein the respective level of lacing power is obtained by entry of an individual closing signal. Is the first or second level of lacing power already reached and a further signal is entered by the user to the closing button a level of lacing power with higher tensioning force is obtained automatically.

Preferably, the third closing signal is a triple tap on the closing button, wherein each two of the tap impulses follow within a predetermined following time and wherein no further tap impulse follows within a predetermined waiting time to the triple tap.

The waiting time is preferably at the most 1.0 seconds.

The following time is preferably between 0.05 seconds and 0.75 seconds, specifically preferred between 0.1 seconds and 0.5 seconds.

The first level of lacing power is thereby preferably defined by a first predetermined maximum current which is pretended to the electric motor by the control system at the lacing process; said current is thereby preferably between 1.1 A and 1.9 A.

Analogue, the second level of lacing power is preferably defined by a second predetermined maximum current which is pretended to the electric motor by the control system at the lacing process, wherein the second maximum current is higher than the first maximum current; said current is preferably between 2.1 A and 2.9 A.

The third level of lacing power is correspondingly preferred defined by a third predetermined maximum current which is pretended to the electric motor by the control system at the lacing process, wherein the third maximum current is higher than the second maximum current; the current is preferably between 3.1 A and 3.9 A.

The control system can also initiates the tension relief of the at least one tensioning element when an opening button is actuated which is different from the closing button.

Thereby, preferably a rotating closure is used at which a gearing is arranged between the tensioning element and the electric motor.

The rotating closure is preferably arranged on the instep of the shoe. The axis of rotation of the tensioning roller is thereby preferably perpendicular to the surface of the shoe in the region of the instep.

Furthermore, a preferred embodiment provides a rotating closure at which the closing button and if applicable the opening button are arranged on the rotating closure.

As a special embodiment of the invention a control system can be used which is in connection with a mobile phone (smart phone) via a wireless connection, especially via a Bluetooth connection, wherein the closing button and if applicable the opening button are formed by the mobile phone. Accordingly, the control of the rotating closure can take place wireless via Bluetooth by a smart phone which is supplied with a respective app for this purpose.

The axis of rotation of the electric motor is preferably horizontally and transverse to the longitudinal direction of the shoe.

The tensioning elements are preferably tensioning wires. They can comprise polyamide or can consist of this material.

The battery which is required for the operation of the motor is preferably a rechargeable battery. The same can be supplied with a charging current by means of an induction coil. The battery can be arranged in a midsole of the shoe. The electronic system which is required for recharging can be arranged directly at the battery. By the provision of an induction coil the battery can be recharged contactless. For doing so the shoe can be placed on a respective recharging plate and so the battery can be recharged.

Accordingly, the proposed concept is basing on the idea to drive the motorized rotating closure to defined closing positions and tensioning force levels respectively by different signals (thus for example a singular tap, a done twice tap and a triple tap respectively onto the closing button). Said tensioning force levels are thereby preferably defined by presetting of a respective motor current (for example first level: 1.5 A—second level: 2.5 A—third level: 3.5 A) so that the motor is operated with corresponding maximum torques which delivers via the used gearing in turn a corresponding rising tensioning force in the tensioning element.

A multiple tap onto the closing button is recognized by the control system by the fact that the tap impulses have a maximum timed distance (see the above mentioned following time); furthermore, the signal which is desired from the user of the shoe is recognized by the fact that after the registered tap impulses no further impulse is detected during a predetermined waiting time.

Beside this direct reaching of the (three) mentioned tensioning force levels it is also possible after putting on the shoe to obtain the next higher tensioning force level by a singular tap.

The (complete) opening of the lacing can take place in one step after the actuation of a respective opening button. For the complete de-laced end position the tensioning roller can be supplied with a rotation angle sensor which can detect the zero-position of the tensioning roller.

Of course, the above described method can also be realized with more than three different tensioning power levels.

So, the operating comfort can be improved in a beneficial manner at the use of a shoe with electro motor operated lacing system by means of a rotating closure.

BRIEF DESCRIPTION OF THE DRAWING

In the drawing an embodiment of the invention is shown.

DETAILED DESCRIPTION OF THE INVENTION

Figure 1:
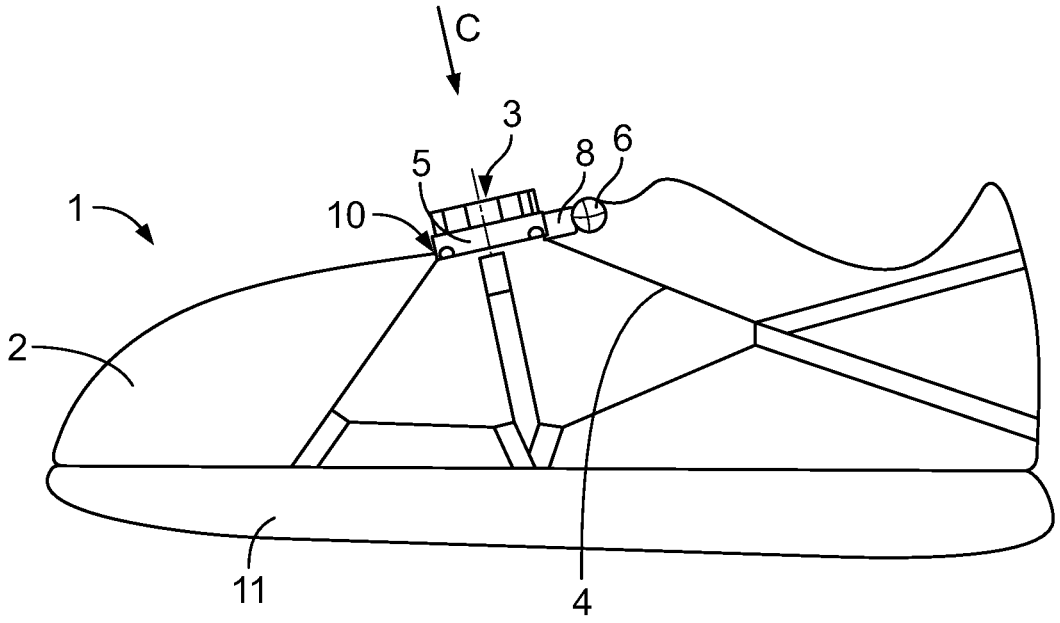
FIG. 1 shows schematically a side view of a sport shoe which can be laced with a rotating closure.

In FIG. 1 a shoe 1 being a sports shoe can be seen which has an upper 2 and a sole 11. The lacing of the shoe 1 takes place by means of a rotating closure 3 (i. e. of a central fastener), wherein by rotating of a tensioning roller 5 at least one tensioning element 4 is winded on the tensioning roller 5 and thus the upper 2 is tensioned and laced respectively at the foot of the wearer of the shoe 1.

Figure 2:
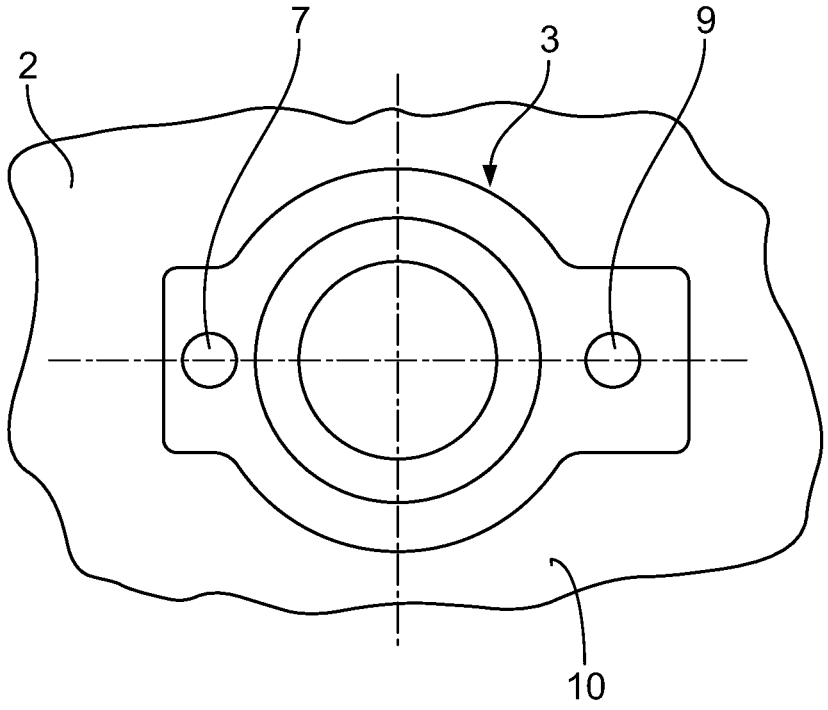
FIG. 2 shows schematically in the view C according to FIG. 1 a part of the instep of the shoe on which a rotating closure is arranged which can be actuated by a closing button and an opening button.

The rotating closure 3 is arranged on the instep 10 of the shoe 1. The axis of rotation of the tensioning roller is thereby perpendicular to the region of the instep 10 of the shoe 1. Accordingly, a convenient access to the rotating closure 3 is ensured for the user of the shoe who must only actuate corresponding buttons, namely a closing button 7 and an opening button 9 (s. FIG. 2), for opening and closing of the rotating closure because the rotating closure 3 is electric motor operated. The electric motor 6 is indicated which is required for that; it can drive the tensioning roller 5 via a—not depicted—gear. In the embodiment the axis of rotation of the electric motor 6 is arranged horizontally and transverse to the longitudinal direction of the shoe.

The actuation of the electric motor 6 for the opening and the closing of the rotating closure 3 is initiated by a control system 8 which is correspondingly also connected with the closing button 7 and the opening button 9.

Figure 3A:
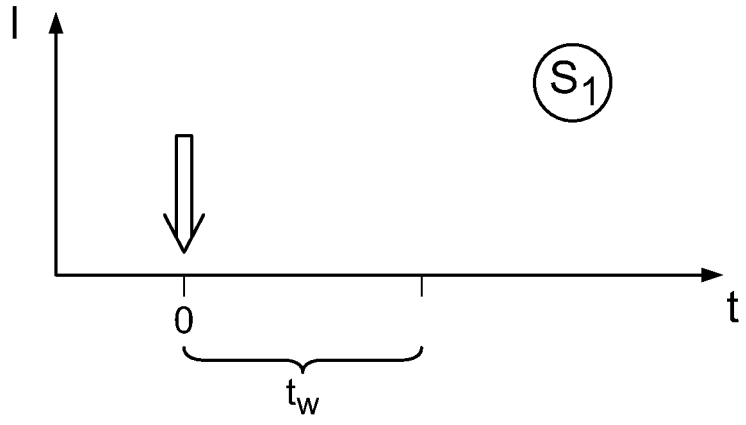
FIG. 3*a* shows a schematic depiction of a first closing signal for the rotating closure.

For closing of the shoe 1 the user proceeds as follows:

When he wants to put on the shoe at his foot with a first (low) tensioning force level he taps once onto the closing button 7. This tap impulse is denoted in FIG. 3*a* with the arrow. The control system 8 registers the tap impulse and waits a waiting time tW to find out if further tap impulses follow by the user. If this is not the case the software which is stored in the control system 8 knows that the user wanted to give a first closing signal S1 which corresponds to said first tensioning force level.

Accordingly the electric motor 6 is driven until a first predetermined maximum value for the motor current is given, for example 1.5 A.

Figure 3B:
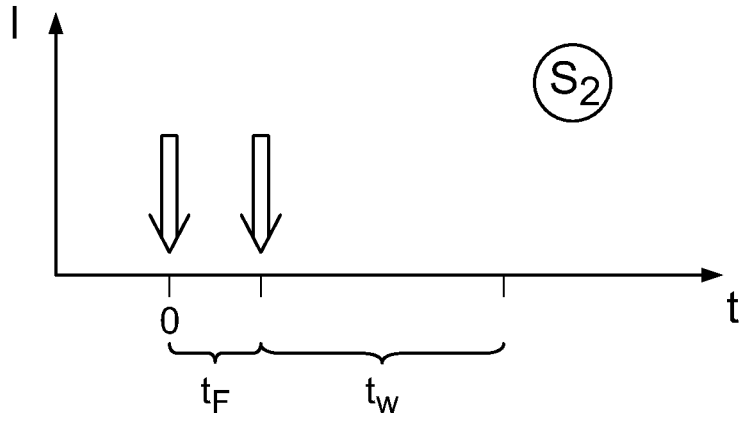
FIG. 3*b* shows a schematic depiction of a second closing signal for the rotating closure and FIG. 3*c* shows a schematic depiction of a third closing signal for the rotating closure.

When the user wants to put on the shoe at his foot with a second (medium) tensioning force level he taps twice onto the closing button 7. This sequence of tap impulses is denoted in FIG. 3*b* with the arrows. The control system 8 registers again the tap impulses wherein intended double impulses—as shown in FIG. 3*b*—can be identified by the fact that they follow within a predetermined following time tF. Otherwise the control system waits again the waiting time tW after the last identified tap impulse to find out if still further tap impulses follow by the user. If this is not the case the software which is stored in the control system 8 knows that the user wanted to give said second closing signal S2 which corresponds to said second tensioning force level.

Accordingly the electric motor 6 is driven now until a second predetermined maximum value for the motor current is given which is higher than the first value, for example 2.5 A.

Figure 3C:
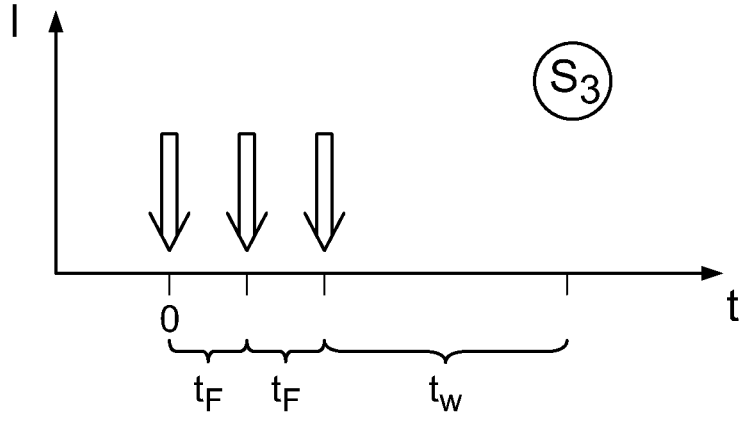

The analogue applies, when the user wants to put on the shoe at his foot with a third (high) tensioning force level. He taps in this case three times onto the closing button 7. This sequence of tap impulses is denoted in FIG. 3*c* with the arrows. The control system 8 registers again the tap impulses wherein intended multiple impulse—as shown in FIG. 3*c*—can be identified by the fact that the time distance between two tap impulses is within the predetermined following time tF. Otherwise the control system waits again the waiting time tW after the last identified tap impulse to find out if still further tap impulses follow by the user. If this is not the case the software which is stored in the control system 8 knows that the user wanted to give said third closing signal S3 which corresponds to said third tensioning force level.

Accordingly the electric motor 6 is driven now until a third predetermined maximum value for the motor current is given which is higher than the second value, for example 3.5 A.

Accordingly the possibility exists by the proposed proceedings to reach a selective tensioning force level by different closing signals S1, S2 and S3 respectively.

The user needs not—as in the state of the art—actuate the closing button 7 for a longer time; rather it is sufficient that he gives the respective sequence of impulses. Furthermore, the user can thereby directly obtain a tensioning force level which fits to his desires without adjusting the same by a respective long pressing of the closing button.

When the shoe fits at least with the first tensioning force level at the foot of the user and when the user presses once onto the closing button 7, when he thus gives a single tap impulse onto the button, the next tensioning force level can be automatically obtained according to a further embodiment, thus from the first into the second tensioning force level or from the second into the third tensioning force level. This is mentioned above when reciting the further closing signal which is applied in the given case by the user to the closing button.

For opening of the shoe, i. e. for releasing of the tensioning element 4, the user presses once onto the opening button 9. The electric motor 6 drives then into the completely tensionless state which can detected by a respective rotation angle sensor at the tensioning roller 5.

LIST OF REFERENCES

1 Shoe
2 Upper
3 Rotating closure
4 Tensioning element
5 Tensioning roller
6 Electric motor
7 Closing button
8 Control system
9 Opening button
10 Instep
11 Sole
S1 First closing signal
S2 Second closing signal
S3 Third closing signal
S4 Further closing signal
tW Waiting time
tF Following time

We claim:

1. A method for lacing a shoe, wherein the shoe comprises:

an upper, wherein at or on the upper a rotating closure is arranged for lacing the shoe at a foot of a wearer by means of at least one tensioning element, wherein the rotating closure comprises a rotatably arranged tensioning roller, wherein the tensioning roller is driven by means of an electric motor, wherein the rotating closure comprises at least one closing button which is connected to a control system which actuates the electric motor, wherein lacing of the shoe is carried out by the user of the shoe generating a closing signal by means of the closing button, wherein the method comprises the steps:

lacing the shoe with a first level of lacing power, resulting in a first tension of the at least one tensioning element, when the user of the shoe generates a first closing signal by means of the closing button, wherein the first closing signal is a first singular tap on the closing button, which is followed by a first predetermined waiting time, after which the electric motor rotates the tensioning roller to achieve the first tension, and lacing the shoe with a second level of lacing power, resulting in a second tension of the at least one tensioning element, which is higher than the first tension, when the user of the shoe generates a second closing signal by means of the closing button, which is different from the first closing signal, wherein the second closing signal is a double tap on the closing button, wherein the double tap impulse occurs within a predetermined following time, and is followed by a second predetermined waiting time, after which the electric motor rotates the tensioning roller to achieve the second tension, wherein the predetermined following time is less than the first predetermined waiting time and the second predetermined waiting time.

2. The method according to claim 1, wherein the method further comprises the step of:

lacing the shoe with a third level of lacing power, resulting in a third tension of the at least one tensioning element, which is higher than the second tension, when the user of the shoe generates a third closing signal by means of the closing button, which is different from the first and second closing signal.

3. The method according to claim 1, wherein after obtaining the first or second level of lacing power in dependence of the applied closing signal the step is carried out:

increasing of the level of lacing power from the first level of lacing power to the second level of lacing power or from the second level of lacing power to the third level of lacing power when the user of the shoe generates a further closing signal by means of the closing button.

4. The method according to claim 3, wherein the further closing signal is a second singular tap on the closing button.

5. The method according to claim 2, wherein the third closing signal is a triple tap on the closing button, wherein the triple tap is followed by a third predetermined waiting time, after which the electric motor rotates the tensioning rover to the third tension.

6. The method according to claim 1, wherein the first predetermined waiting time or the second predetermined waiting time are at the most 1.0 second.

7. The method according to claim 1, wherein the predetermined following time is between 0.05 seconds and 0.75 seconds.

8. The method according to claim 1, wherein the first level of lacing power is defined by a first predetermined maximum current which is sent to the electric motor by the control system at the lacing process, wherein the first predetermined maximum current is between 1.1 A and 1.9 A.

9. The method according to claim 8, wherein the second level of lacing power is defined by a second predetermined maximum current which is sent to the electric motor by the control system at the lacing process, wherein the second maximum current is higher than the first maximum current, wherein the second predetermined maximum current is between 2.1 A and 2.9 A.

10. The method according to claim 2, wherein the third level of lacing power is defined by a third predetermined maximum current which is sent to the electric motor by the control system at the lacing process, wherein the third predetermined maximum current is between 3.1 A and 3.9 A.

11. The method according to claim 1, wherein the control system initiates tension relief of the at least one tensioning element when an opening button is actuated which is different from the closing button.

12. The method according to claim 1, wherein a gearing is arranged between the at least one tensioning element and the electric motor.

13. The method according to claim 1, wherein the rotating closure is arranged on an instep of the shoe.

14. The method according to claim 1, wherein the rotating closure is used at which the closing button and if applicable an opening button are arranged on the rotating closure.

15. The method according to claim 14, wherein the control system is used which is in connection with a mobile phone via a wireless connection, wherein the closing button and opening button are formed by the mobile phone.

16. The method according to claim 1, wherein a controller provides instructions that cause the steps of the method to be initiated.

17. The method according to claim 1, wherein the first predetermined waiting time and the second predetermined waiting time are the same.

18. The method according to claim 5, wherein the first predetermined waiting time, the second predetermined waiting time, and the third predetermined waiting time are the same.

* * * * *